United States Patent [19]

Retallick

[11] Patent Number: 4,545,430

[45] Date of Patent: Oct. 8, 1985

[54] CATALYTIC COMBUSTOR HAVING SPIRAL SHAPE

[76] Inventor: William B. Retallick, 1432 Johnny's Way, West Chester, Pa. 19380

[21] Appl. No.: 620,630

[22] Filed: Jun. 14, 1984

Related U.S. Application Data

[63] Continuation-in-part of Ser. No. 412,295, Aug. 27, 1982, abandoned.

[51] Int. Cl.[4] ..... E21B 43/00

[52] U.S. Cl. ..... 166/59; 431/243; 431/158; 431/353

[58] Field of Search ..... 431/158, 243, 350, 353, 431/DIG. 1; 166/59

[56] References Cited

PUBLICATIONS

"Limits to Energy Release and Utilization from Chemical Fuels", *Nature*, vol. 257, pp. 367–370, Oct. 2, 1975 by S. A. Lloyd and F. J. Weinberg.

Pangborn, Jon B., "Catalytic Combustion of Hydrogen in Model Appliance", Conference: Energy to the 21st Century, Proceedings of the 15th Intersociety Energy Conversion Engineering Conference, Seattle, WA, (Aug. 18–22, 1980), pp. 1731–1736.

*Primary Examiner*—Carroll B. Dority, Jr.

*Attorney, Agent, or Firm*—William H. Eilberg

[57] ABSTRACT

The combustor comprises a single sheet of metal coated with catalyst and wound into a spiral. There is a single spiral passage leading into the core of the spiral. The fuel-air mixture burns on the catalyzed surface of the spiral, and heat is transferred through the metal wall of the spiral to the incoming fuel-air mixture. The incoming fuel-air mixture is preheated to a temperature sufficient to start the catalytic combustion. The fuel content in the mixture can be below the flammability limit. The combustor is compact so that it can be used as a catalytic air preheater in a downhole steam generator.

12 Claims, 4 Drawing Figures

CATALYTIC COMBUSTOR HAVING SPIRAL SHAPE

CROSS REFERENCE TO OTHER APPLICATION

This is a continuation-in-part of my patent application Ser. No. 412,295, filed Aug. 27, 1982 and now abandoned.

BACKGROUND OF THE INVENTION

This invention concerns the catalytic combustion of fuel downhole in an oil well. Through the use of downhole combustors, steam can be generated downhole and injected into the reservoir to displace heavy oil from the reservoir. The present combustor is compact so that it can fit into an oil well.

Any mixture of fuel and air, no matter how long its heating value, will burn if it is preheated to a sufficiently high temperature. If the mixture is burned over a catalyst, a lower preheat temperature is required, and this is why catalysts are used to burn mixtures having a low heat value. With or without a catalyst, preheating is usually done by exchanging heat from the combustion gas to the incoming fuel-air mixture. Some systems operate in such tight confines that it is difficult to include a heat exchanger.

My U.S. Pat. No. 4,445,570, the disclosure of which is incorporated by reference herein, describes a downhole steam generator having a catalytic air preheater. The air preheater transfers heat from the combustion gas, through a metal wall, to the incoming fuel-air mixture. The design is compact, but intricate. The catalytic combustor of the present invention is simpler and does the same job.

SUMMARY OF THE INVENTION

The combustor of the present invention comprises a single sheet of metal coated with catalyst and wound into a spiral. There is a single spiral passage leading into the core of the spiral. The fuel-air mixture burns on the catalyzed surface of the spiral, and heat is transferred through the metal wall of the spiral to the incoming fuel-air mixture. The incoming fuel-air mixture is preheated to a temperature sufficient to start the catalytic combustion. Substantially all of the combustion gas is withdrawn directly from the core of the spiral by a suitable channel.

When the combustor is used in a downhole steam generator, the fuel can be methane or natural gas, at a concentration below the flammability limit. It is convenient to mix the air and methane at ground level, and then to pipe the mixture downhole through a single pipe. It is safe to do this because the mixture will not sustain a flame. The mixture can be preheated and burned in the combustor disclosed here. Thus, the present invention can accomplish the same objective as that of U.S. Pat. No. 4,445,570.

It is therefore an object of the invention to provide a catalytic combustor that preheats the incoming fuel-air mixture to the temperature for catalytic combustion.

It is another object of the invention to provide a catalytic combustor for fuel-air mixtures that are below the flammability limit.

It is another object to provide a catalytic air preheater that is compact so that it fits in the tight confines of an oil well.

It is another object to provide a spiral catalytic combustor wherein substantially all of the combustion gas is withdrawn directly from the core of the spiral.

Other objects and advantages of the invention will be apparent to those skilled in the art, from a reading of the following brief description of the drawings, the detailed description of the invention, and the appended claims.

DETAILED DESCRIPTION OF THE INVENTION

Figure 1:
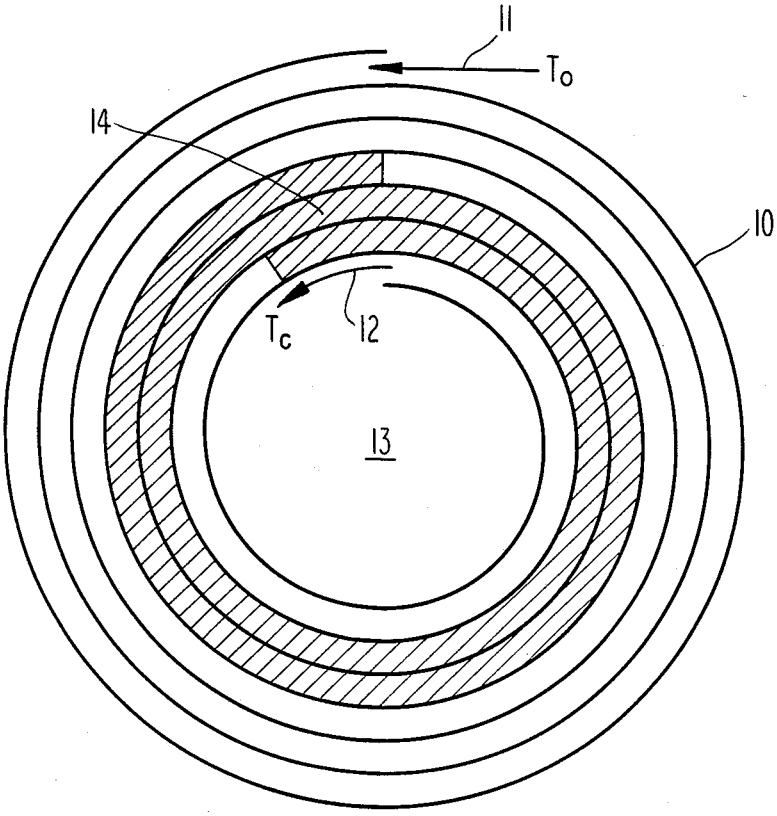
FIG. 1 is a cross-sectional view of the spiral combustor of the present invention.

FIG. 1 is a cross-sectional view of the spiral combustor of the present invention. The combustor comprises a single sheet of metal 10, which is coated with a suitable combustion catalyst, and wound into a spiral. The fuel-air mixture enters at $T_o$ as indicated by arrow 11, and leaves at $T_c$ as indicated by arrow 12, through hollow core 13. $T_o$ indicates the initial temperature of the mixture, and $T_c$ designates the temperature of the mixture after complete combustion. The adiabatic temperature rise from combustion is therefore $T_c - T_o$. The adiabatic temperature rise $T_c - T_o$ can be calculated from the heating value of the fuel and the concentration of fuel in the mixture. The region of combustion is designated by the shaded area 14. Combustion zone 14 starts wherever the fuel-air mixture has been preheated sufficiently to start the catalytic combustion. There must be enough turns in the spiral so that combustion zone 14 does not reach the inside end of the spiral. This insures that the combustion is complete. The number of turns of the spiral before the combustion starts can vary, and the illustration in FIG. 1 is not meant to be exact. Depending on the fuel concentration and other factors, the combustion could start closer to, or farther from, the entrance to the spiral.

The spiral shown in cross-section in FIG. 1 is constructed of metal, and when used in a downhole steam generator (to be more fully described below) would have the shape of a long, slim cylinder, which could be 5 to 8 inches in diameter and 3 to 6 feet long. The number of turns could be of the order of six, but this number could vary. Although a coating of catalyst is needed only in the combustion zone 14 of the spiral, it is simpler to coat the entire spiral with catalyst by dipping the entire structure in a suitable catalyst material.

The turns of the spiral are held in spaced-apart relation by suitable means, such as closure means for the ends of the spiral. These closure means are described more fully in connection with the specific embodiment shown below.

Figure 2:
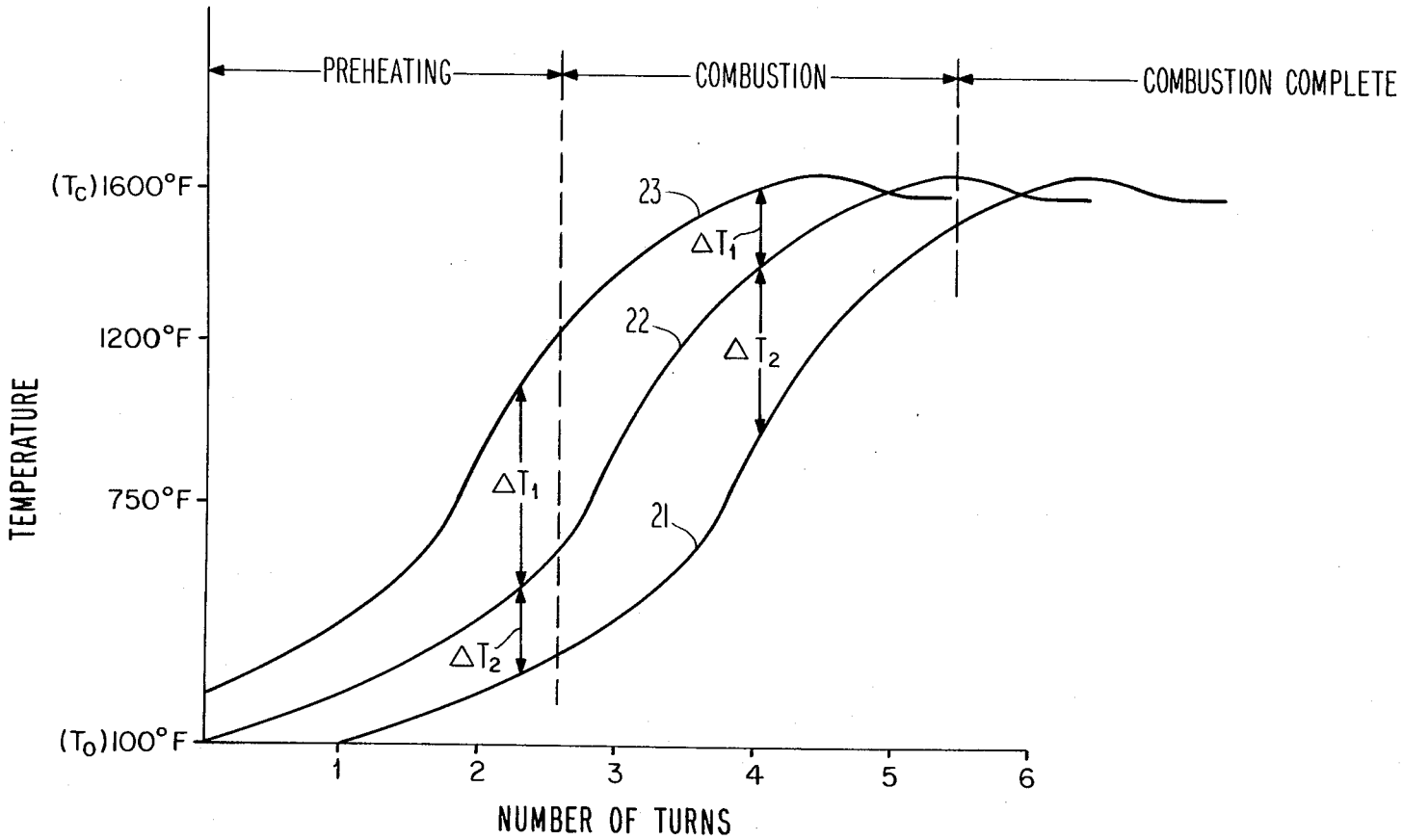
FIG. 2 is a graph showing the temperature profile of the fuel-air mixture as it passes through the spiral combustor of the present invention.

In FIG. 2, curve 22 represents the temperature profile of the fuel-air mixture as it passes through the spiral. Temperature is plotted on the vertical axis, and the number of turns of the spiral that have been traversed by the mixture is plotted on the horizontal axis. The numbers of turns indicated in FIG. 2 are not intended to be exact. More or fewer turns would be needed, depending on the diameter of the spiral and the spacing between the layers. Also, the temperatures shown are not intended to be exact; what is important in FIG. 2 is the shape of the curves, as will be more fully explained below. The diagram shows three regions: the preheating zone, the combustion zone, and the zone wherein combustion has been completed.

Curve 23 is obtained by shifting curve 22 to the left by one turn of the spiral. Curve 21 is obtained by shifting curve 22 to the right by one turn of the spiral. Curve 23 therefore represents the temperature of that part of the fuel-air mixture which has traversed one more turn of the spiral than has the mixture at that point of curve 22 having the same abscissa. Curve 21 represents the temperature of the mixture which has traversed one less turn, as compared with the mixture at the corresponding point of curve 22.

Now consider a portion of the fuel-air mixture at a given point in the spiral (i.e. anywhere on curve 22). This portion of the mixture receives heat from the mixture that has already traversed one additional turn of the spiral, whose temperature is given by curve 23. Likewise, as the fuel-air mixture flows along curve 22, it is transferring heat to the mixture that has traversed one less turn of the spiral, whose temperature is given by curve 21. At any point along curve 22, the temperature potential for heating the mixture is indicated by $\Delta T_1$ and the potential for cooling the mixture is indicated by $\Delta T_2$. The value of $\Delta T_1$ at any point is just the difference between the temperatures indicated by curves 23 and 22 for that point. Likewise, $\Delta T_2$ is the difference in temperatures, for any point, between curves 21 and 22. For the mixture to be heated, $\Delta T_1$ must exceed $\Delta T_2$. For $\Delta T_1$ to exceed $\Delta T_2$, the temperature curve 22 must have an ever-increasing slope. That is, the curve 22 must be concave upward.

If curve 22 were a straight line, then curves 21 and 23 would be straight also, and equidistant from curve 22, so that $\Delta T_1$ would equal $\Delta T_2$. Then the fuel-air mixture would not be heated at all, and the combustor would not function.

The requirement that $\Delta T_1$ exceed $\Delta T_2$ applies only until the fuel-air mixture becomes hot enough to start catalytic combustion. Then the mixture generates its own heat and its temperature will continue to increase, even toward the end of the combustion zone, where $\Delta T_2$ exceeds $\Delta T_1$, as shown. If there are additional turns in the spiral beyond the combustion zone, curves 21, 22, and 23 will merge, and $\Delta T_1$ and $\Delta T_2$ will both approach zero, as shown, after possibly overshooting $T_c$, the combustion temperature. $T_c$ is indicated as 1600° F. on the figure. What is critical in FIG. 2 is that the curve 22 be concave upward in the region of preheating.

A spiral combustor has been described in articles in *Nature*, Vol. 257, page 367 (1975), Vol. 251, page 47 (1974), and Vol. 233, page 239 (1971). The spiral described in *Nature* is a double spiral made by winding two sheets of metal instead of a single sheet. There are two spiral passages in the double spiral, one leading into the core of the spiral, and the other leading out. The hot combustion gas emerges at the outside of the spiral. With the single spiral, the hot combustion gas emerges at the core of the spiral. When the combustor is used in a downhole steam generator, it is preferable to withdraw the heat of combustion from the core of the spiral. In this way, the hot gas loses less heat through the wall of the oil well casing.

Figure 3:
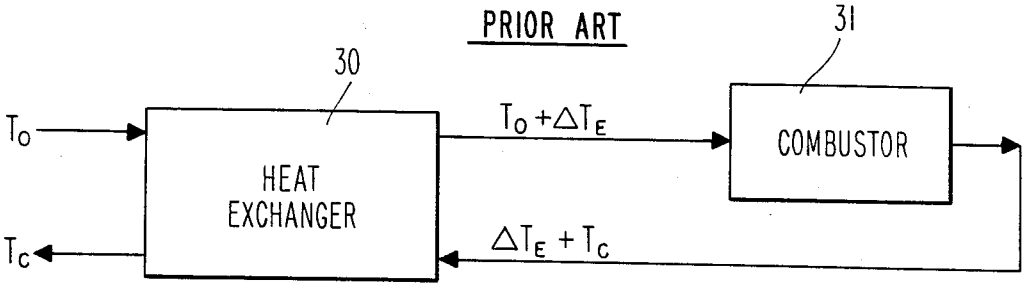
FIG. 3 is a schematic diagram illustrating the principle of countercurrent heat exchange.

The double spiral shown in the above-cited articles could be catalyzed, but no unexpected results would be achieved. The uncatalyzed double spiral is already capable of burning mixtures wherein the fuel content is below the flammability limit. This is so because the incoming fuel-air mixture flows countercurrently to the exiting hot combustion gas, which is not the case in the single spiral of the present invention. FIG. 3 is a schematic diagram which illustrates the principle of countercurrent heat exchange. There is a countercurrent heat exchanger 30, which could be the preheating zone of a double spiral, and a combustor 31 which could be the combustion zone of a double spiral. The fuel-air mixture enters at temperature $T_o$ and is heated to a temperature $T_o+\Delta T_E$ in the exchanger. In the combustor the temperature increases to $\Delta T_E+T_C$. Then the combustion gas passes through exchanger 30, and the temperature drops to $T_C$. Now $\Delta T_E$ can be increased indefinitely by increasing the area for heat transfer in exchanger 30. Likewise the temperature of the gas leaving the combustor, $\Delta T_E+T_C$, can be made high enough to burn any fuel-air mixture, with or without a catalyst.

The heat-exchange described above is accomplished at the expense of using the double spiral instead of the single spiral. The single spiral is more compact, but it will not work unless it is coated with catalyst, except perhaps with the most combustible fuels, such as hydrogen. The articles cited above make no mention of a single spiral, or how a single spiral combustor could be made to work. One of the articles cited above does show a double spiral combustor wherein some of the heat of combustion is removed from the combustion gas at the core of the spiral, before the combustion gas exits through the outgoing passage of the spiral. If, instead of this indirect cooling at the core of the spiral, all of the combustion gas had been withdrawn through the core of the spiral, the double spiral combustor of the cited articles would not work. The reason is that there would have been no preheating of the incoming fuel-air mixture.

As shown in FIG. 3 and by the diagrams in the cited articles, the maximum temperature in the double spiral can greatly exceed $T_c$. In the single spiral, the maximum temperature hardly exceeds $T_c$, as shown in FIG. 2. When the fuel is methane, the temperature required for rapid combustion without a catalyst is about 1200° F., but with a catalyst of palladium or platinum, this temperature is reduced to about 750° F. If the combustor is used as a catalytic air preheater in a downhole steam generator, a practical value for the preheat temperature $T_c$ would be 1600° F. These temperatures are indicated on FIG. 2, in addition to $T_o$ which was assumed to be 100° F. FIG. 2 shows that toward the end of the preheating zone, $\Delta T_1$ greatly exceeds $\Delta T_2$, as it must to generate the ever increasing slope of curve 22. All this is possible when the catalytic combustion starts at only about 750° F. If there were no catalyst, and the combustion did not start until 1200° F., the short interval between 1200° F. and 1600° F. would make it difficult or impossible to establish a high ratio of $\Delta T_1$ to $\Delta T_2$. If the fuel-air mixture were leaned out so that $T_c$ itself is reduced to 1200° F., then the single spiral combustor would not work at all without a catalyst coating.

Figure 4:
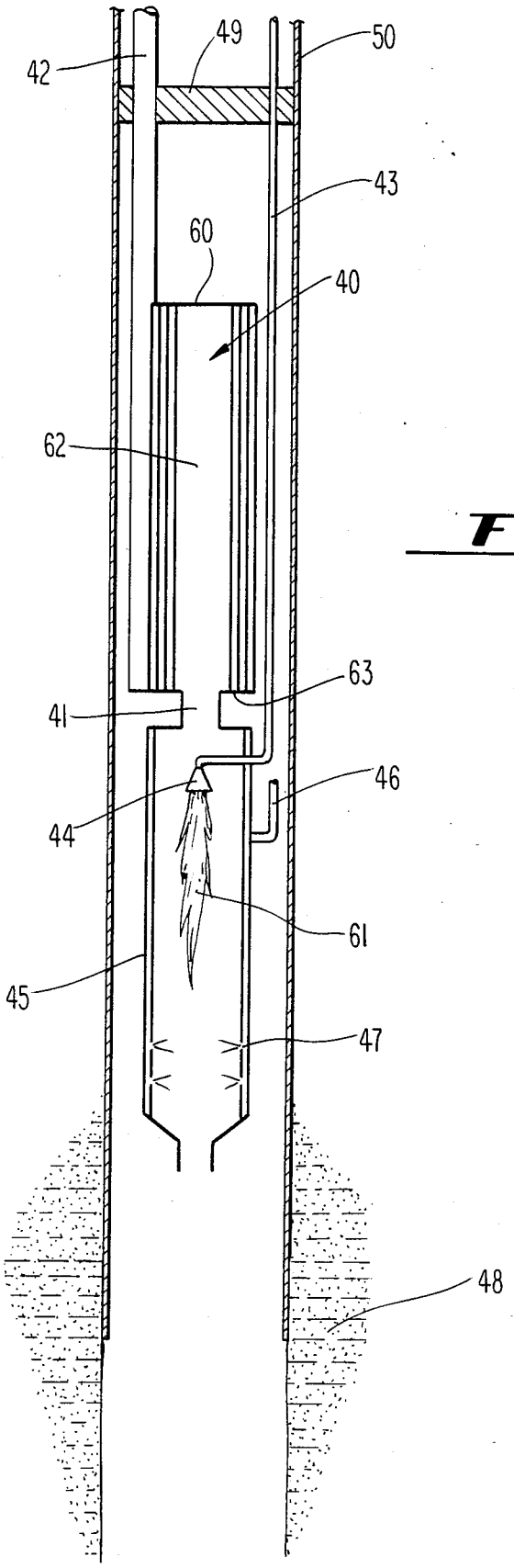
FIG. 4 is a partially schematic, cross-sectional view of a downhole steam generator constructed according to the present invention.

FIG. 4 shows the single spiral combustor used as a catalytic air preheater in a downhole steam generator. A cylindrical bore is drilled into oil bearing formation 48. Formation 48 may typically be sandstone, as indicated schematically in the figure. The complete two-stage combustor apparatus is enclosed within cylindrical casing 50 which is inserted into formation 48. It is understood that formation 48 extends at least the entire length of casing 50, although the formation has been shown in abbreviated form in the figure. Also, the uncased bore will typically extend well below the casing itself, so as to allow steam from the combustor to enter the formation 48.

Spiral combustor 40 is shown in FIG. 4. Combustor 40 is the same kind of combustor as is shown in FIG. 1. The number of turns may vary. As in FIG. 1, the spiral combustor has a central core 62, from which the combustion gas is withdrawn.

Spiral combustor 40 has a solid closure 60 at its upper end, and exit duct 41 for the preheated air at its lower end. Solid closure 60 holds the turns of the spiral in spaced-apart relation. Second closure means 63 also holds the turns of the spiral in place, and defines the exit duct 41. It is thus apparent that substantially all of the combustion gas is withdrawn from the core of the spiral, as was described in reference to FIG. 1.

The pre-mixed fuel-air mixture enters through duct 42. Duct 42 may, in one embodiment, be a pipe which contains a plurality of holes connected to smaller ducts (not shown). The smaller ducts would be connected to holes (not shown) in the outer turn of spiral 40. In this embodiment, the outer turn of spiral 40 would be sealed to the succeeding turn, so that the only way for the fuel-air mixture to enter the spiral 40 would be through the smaller ducts described above. In an alternative embodiment, duct 42 would extend only to the edge of the spiral 40, and the fuel-air mixture would enter spiral 40 through a hole (not shown) in solid closure 60.

The hot gas exiting from spiral combustor 40 then is directed to the second, conventional combustion stage. Liquid fuel enters through liquid fuel duct 43 and burns at the burner nozzle 44, in the presence of the preheated air passing through exit duct 41. The flame is contained within the double walled combustion chamber 45. Water enters the space between the double walls of chamber 45 through water duct 46 and enters the combustion chamber 45 through spray jets 47. The source of the water is not shown. The water quenches the hot combustion gas to form a mixture of steam and combustion gas that is forced into the oil bearing formation 48. A pressure seal for the entire apparatus is made by packer 49 against the wall of the casing 50. The spiral combustor 40 and combustion chamber 45 are constructed as a unitary assembly, and are free of casing 50. Thus, spiral 40 and chamber 45 can be pulled out of the oil well as a unit.

Configurations other than that of FIG. 4 could be used for burning the liquid fuel and quenching the resulting combustion gas. U.S. Pat. No. 4,336,839 shows an example. What is unique in the present invention, as illustrated in the embodiment of FIG. 4, is that the liquid fuel is burned with air that is already preheated to about 1600° F. This permits the burning of heavy residual oil or topped crude oil, which could not be burned without preheated air. Without preheated air, only the more expensive distillate fuels can be burned.

One method of starting the combustion is to precede the mixture of methane and air with a mixture of hydrogen and air. Hydrogen, unlike methane, will ignite on the catalyst at ambient temperature.

It is apparent that the objects of the invention are fulfilled by the above disclosure. It is to be understood that many modifications of the invention are possible, some of which have been discussed above. These modifications are to be deemed within the spirit and scope of the following claims.

What is claimed is:

1. A catalytic combustor comprising a single sheet of metal, the sheet being coated with catalyst, the sheet being wound into a spiral, the combustor having first closure means at one end, the first closure means comprising means for preventing gas flow out of said end of the spiral, the combustor having second closure means at the other end of the spiral, the second closure means having an opening communicating with the core of the spiral, wherein the opening is the sole path for exit of combustion gas from the spiral.

2. The combustor of claim 1, wherein said first and second closure means comprise means for maintaining the layers of the spiral in spaced-apart relation.

3. A steam generator for use downhole in an oil well, comprising:

(a) a cylindrical casing inserted into the oil well, (b) a catalytic combustor mounted in the upper region of the interior of the casing, the catalytic combustor comprising a single sheet of metal wound into a spiral, the spiral being coated with catalyst, the spiral having closure means at either end, wherein the closure means at the lower end of the spiral comprises means for directing combustion gas out of the spiral, (c) first duct means for delivering a fuel-air mixture to the catalytic combustor, (d) conventional combustor means positioned below the catalytic combustor, within the casing, the conventional combustor means having means for receiving combustion gas from the catalytic combustor, (e) second duct means for delivering liquid fuel to the conventional combustor means, (f) third duct means for delivering water to the conventional combustor means, (g) spray jet means for spraying water onto the combustion flame of the conventional combustor means, and (h) means for directing steam out of the lower end of the conventional combustor means and into the oil well.

4. The steam generator of claim 3, wherein the steam generator is substantially sealed by pressure seal means near the upper end of the generator.

5. The steam generator of claim 4, wherein the gas receiving means comprises a cylindrical channel connecting the spiral combustor with the conventional combustor means.

6. The steam generator of claim 5, wherein the closure means at the upper end of the spiral comprises means for preventing gas flow out of said upper end of the spiral.

7. Apparatus for generating steam downhole downhole in an oil well comprising a catalytic combustor, the catalytic combustor comprising a single sheet of metal coated with catalyst and wound into a spiral, a conventional combustor means, means for directing combustion gas from the catalytic combustor to the conventional combustor means, and means for injecting water into the conventional combustor means, whereby steam is generated within the conventional combustor means.

8. The apparatus of claim 7, wherein the catalytic combustor has a hollow core, and wherein substantially all of the combustion gas from the catalytic combustor is withdrawn through the core of the spiral.

9. The apparatus of claim 8, wherein the catalytic combustor has closure means on both ends of the spiral, the closure means comprising means for maintaining the turns of the spiral in spaced-apart relation.

10. The apparatus of claim 9, wherein at least one of said closure means defines an opening through which gas can flow.

11. The apparatus of claim 10, wherein the catalytic combustor and the conventional combustor means are mounted within a unitary cylindrical casing.

12. A catalytic combustor comprising a single sheet of metal coated with catalyst and wound into a spiral, the layers of the spiral being held in spaced-apart relation, closure means at each end of the spiral, one of said closure means defines an opening through which gas can flow, the spiral forms a hollow core in communication with the opening in said closure means.

* * * * *